US010118728B2

(12) United States Patent
Yamamoto

(10) Patent No.: US 10,118,728 B2
(45) Date of Patent: Nov. 6, 2018

(54) STORAGE CASE

(71) Applicant: Shinwa Co., Ltd., Niigata-Pref. (JP)

(72) Inventor: Kazunobu Yamamoto, Niigata-Pref. (JP)

( * ) Notice: Subject to any disclaimer, the term of this patent is extended or adjusted under 35 U.S.C. 154(b) by 0 days.

(21) Appl. No.: 15/693,501

(22) Filed: Sep. 1, 2017

(65) Prior Publication Data

US 2018/0194513 A1 Jul. 12, 2018

(30) Foreign Application Priority Data

Jan. 10, 2017 (JP) ..... 2017-002177

(51) Int. Cl.

| | |
|---|---|
| ***A47B 43/00*** | (2006.01) |
| ***B65D 6/24*** | (2006.01) |
| ***A47B 87/02*** | (2006.01) |
| ***B65D 21/02*** | (2006.01) |

(52) U.S. Cl.

CPC ..... *B65D 11/1893* (2013.01); *A47B 43/00* (2013.01); *A47B 87/0284* (2013.01); *B65D 21/0213* (2013.01)

(58) Field of Classification Search

CPC . A47B 43/00; A47B 87/0284; A47B 87/0292; A47B 47/042; A47B 47/0091; A47B 47/025; B65D 11/1893; B65D 21/0213

USPC ..... 312/107, 108, 111, 258, 262, 330.1

See application file for complete search history.

(56) References Cited

U.S. PATENT DOCUMENTS

| | | | | | |
|---|---|---|---|---|---|
| 1,212,429 | A * | 1/1917 | Weinstein | B65D 7/26 | 220/6 |
| 2,475,513 | A * | 7/1949 | Peckinpaugh | F25D 25/005 | 220/6 |
| 4,591,065 | A * | 5/1986 | Foy | B65D 11/1833 | 206/509 |
| 4,662,515 | A * | 5/1987 | Newby, Sr. | B25H 3/02 | 206/349 |
| 4,717,214 | A * | 1/1988 | Moore | A47D 5/00 | 220/7 |
| 6,170,689 | B1 * | 1/2001 | Flesher | B65D 19/06 | 206/508 |
| 6,193,340 | B1 * | 2/2001 | Schenker | A47B 47/0075 | 312/108 |

(Continued)

FOREIGN PATENT DOCUMENTS

| | | | |
|---|---|---|---|
| DE | 102006059748 | * | 6/2008 |
| DE | 102010002530 | * | 7/2011 |
| FR | 2871782 | * | 12/2005 |

*Primary Examiner* — Janet M Wilkens

(74) *Attorney, Agent, or Firm* — Prakash Nama; Global IP Services, PLLC

(57) ABSTRACT

A storage case includes a frame, a top plate, and a drawer. The frame includes a bottom plate, side plates, and a rear plate. The top plate covers the upper side of the frame. The drawer is freely pulled out of and pushed into the frame through an open front side of the frame. The side plates of the frame are foldable between an upright position, at which the side plates extend upright from left and right sides of the bottom plate, and a folded position, at which the plates extend along an upper surface of the bottom plate. The rear plate is foldable between an upright position, at which the rear plate extends upright from a rear side of the bottom plate, and a folded position, at which the rear plate extends along a lower surface of the bottom plate.

2 Claims, 16 Drawing Sheets

(56) References Cited

U.S. PATENT DOCUMENTS

| | | | | |
|---|---|---|---|---|
| 8,714,388 | B2 * | 5/2014 | Miller | B65D 11/1893 206/508 |
| 9,095,212 | B2 * | 8/2015 | Yamamoto | A47B 87/0292 |
| 2002/0109442 | A1 * | 8/2002 | Hsu | A47B 47/042 312/263 |
| 2006/0250052 | A1 * | 11/2006 | Davis | A47B 47/042 312/107 |
| 2007/0051720 | A1 * | 3/2007 | Chen | B65D 11/1846 220/6 |
| 2007/0080614 | A1 * | 4/2007 | Stein | A47B 47/042 312/107 |
| 2007/0145865 | A1 * | 6/2007 | Richter | A47B 47/025 312/111 |
| 2010/0108549 | A1 * | 5/2010 | Eggers | B25H 3/023 206/349 |
| 2012/0181904 | A1 * | 7/2012 | Ma | A47B 67/04 312/108 |
| 2015/0342341 | A1 * | 12/2015 | Glekas | A47B 47/0091 312/111 |
| 2018/0192772 | A1 * | 7/2018 | Yamamoto | A47B 88/919 |

* cited by examiner (12A)

(12B)

STORAGE CASE

BACKGROUND OF THE INVENTION

The present invention relates to a storage case used in, for example, a typical household to store and organize clothing and various small items or the like.

A storage case known in the prior art includes a frame, a top plate, and a drawer. The frame, which is formed from a synthetic resin, includes a bottom plate, a left side plate, a right side plate, a rear plate, a front side having an opening, and an upper side having an opening. The top plate is formed from a synthetic resin and covers the upper side of the frame. The frame and the top plate form a main body. The drawer can be freely pulled out of and pushed into the main body through the opening in the front side of the frame. The drawer is formed from a synthetic resin and includes an open upper side.

The main body may have an integrated structure in which the left side plate, the right side plate, and the rear plate are formed integrally with the left, right, and rear sides of the bottom plate. Alternatively, the main body may have a non-integrated structure in which the left side plate, the right side plate, and the rear plate are coupled in a removable manner to the left, right, and rear sides of the bottom plate. When the storage case is not in use such as during transportation or storage, the integrated structure, which is bulky, will require vast space for storage. Further, the non-integrated structure will require separate space for the storage of the left side plate, the right side plate, the rear plate, and the bottom plate. In addition, the left side plate, the right side plate, the rear plate, and the bottom plate may become lost.

BRIEF SUMMARY OF THE INVENTION

To solve such problems, one aspect of the present invention provides a storage case including a frame, a top plate, a main body, and a drawer. The frame includes a bottom plate, left and right side plates, a rear plate, an open front side, and an open upper side. The frame is formed from a synthetic resin. The top plate covers the upper side of the main body. The top plate is formed from a synthetic resin. The main body includes the frame and the top plate. The drawer is freely pulled out of and pushed into the main body through the opening in the front side of the frame in the main body. The drawer is formed from a synthetic resin and includes an open upper side. The left and right side plates are foldable between an upright position, at which the left and right side plates extend upright from left and right sides of the bottom plate of the frame, and a folded position, at which the left and right side plates extend along an upper surface of the bottom plate. The rear plate is foldable between an upright position, at which the rear plate extends upright from a rear side of the bottom plate of the frame, and a folded position, at which the rear plate extends along a lower surface of the bottom plate.

A further aspect of the present invention provides a storage case including a plurality of frames, a top plate, a main body, and a plurality of drawers. The frames can be stacked one upon the other, each frame including a bottom plate, left and right side plates, a rear plate, a front open side, and an open upper side. The frames are formed from a synthetic resin. The top plate covers the upper side of an uppermost one of the stacked frames. The top plate is formed from a synthetic resin. The main body includes the frames and the top plate. The drawers are freely pulled out of and pushed into the main body through the open front sides of the frames in the main body. The drawers are formed from a synthetic resin and each of the drawers includes an open upper side. The left and right side plates of each frame are foldable between an upright position, at which the left and right side plates extend upright from left and right sides of the corresponding bottom plate, and a folded position, at which the left and right side plates extend along an upper surface of the corresponding bottom plate. The rear plate of each frame is foldable between an upright position, at which the rear plate extends upright from a rear side of the corresponding bottom plate, and a folded position, at which the rear plate extends along a lower surface of the corresponding bottom plate.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

FIGS. 1 to 16 show embodiments according to the present invention. FIGS. 1 to 12 show a first embodiment, and FIGS. 13 to 16 show a second embodiment.

Figure 1:
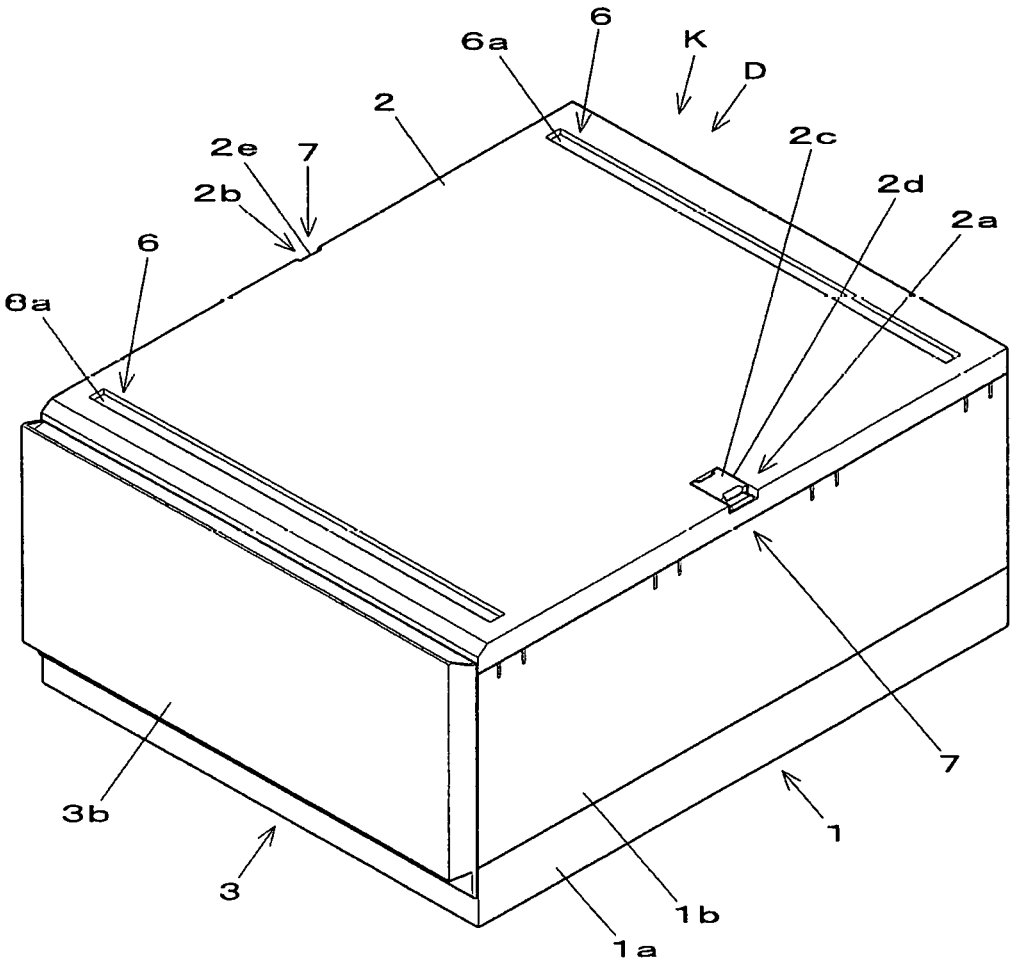
FIG. 1 is a perspective view of a first embodiment according to the present invention.
Figure 2:
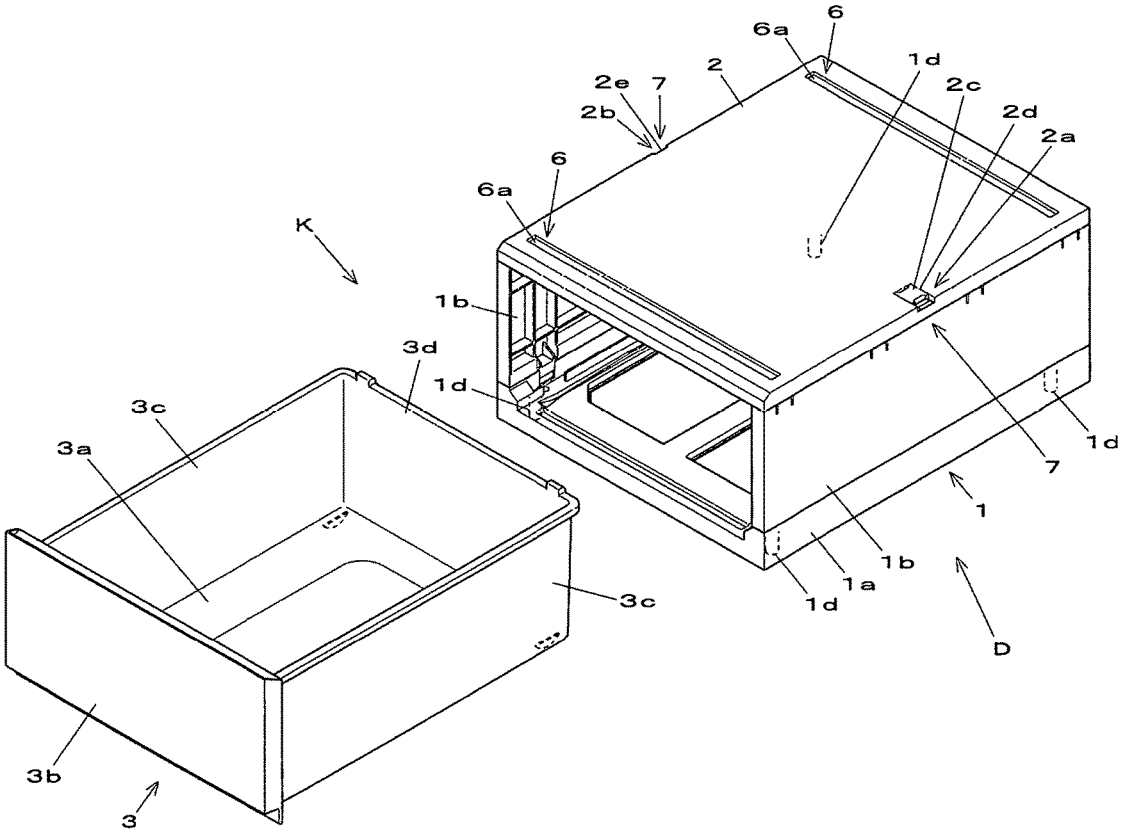
FIG. 2 is a perspective view of the first embodiment according to the present invention.
Figure 3:
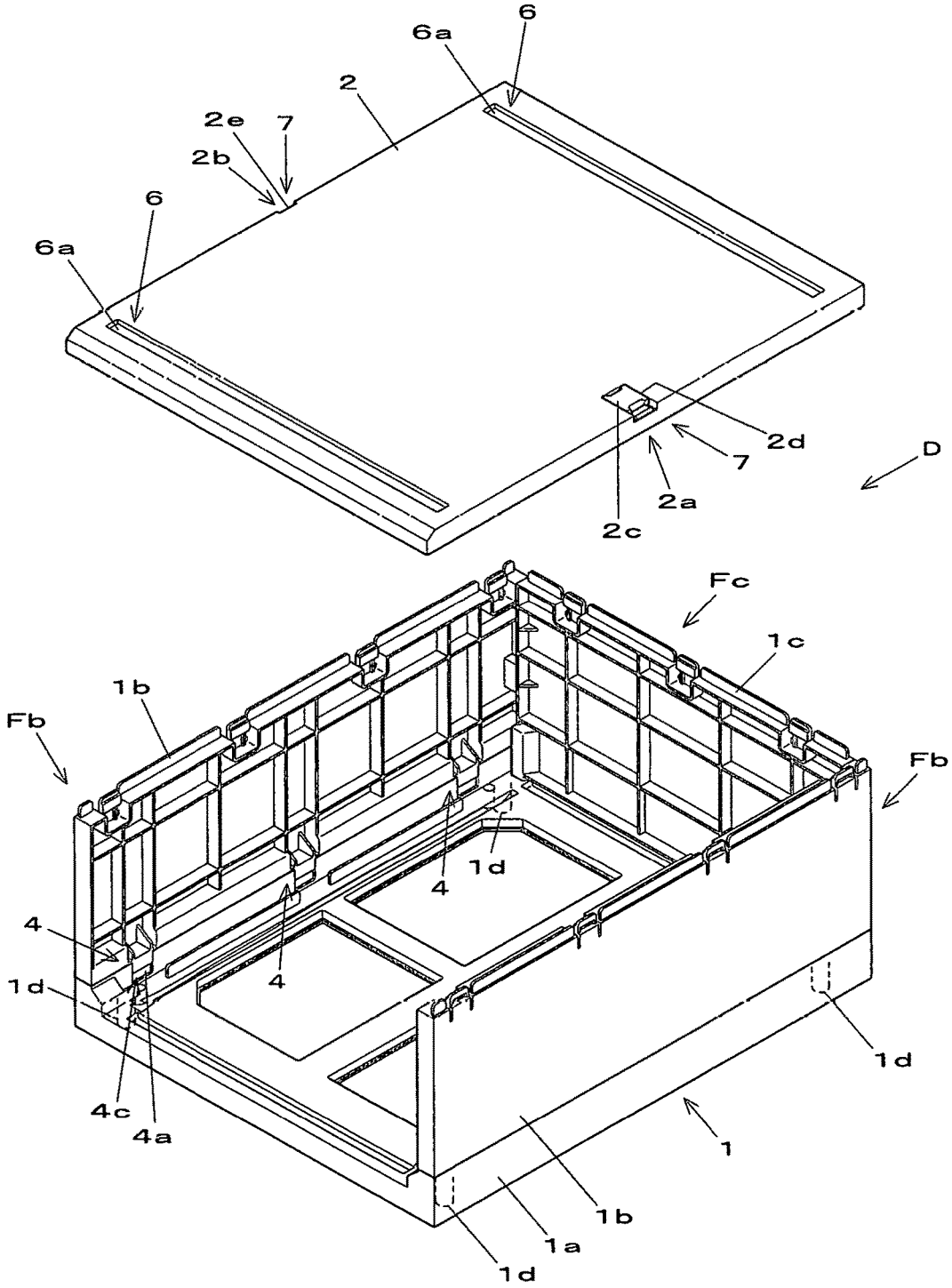
FIG. 3 is an exploded perspective view showing part of the first embodiment according to the present invention.

In the first embodiment of FIGS. 1 to 12, a frame 1, which is formed from a synthetic resin and shown in FIGS. 2 and 3, includes a bottom plate 1*a*, left and right side plates 1*b*, a rear plate 1*c*, an open front side, and an open upper side.

As shown in FIGS. 1, 2, and 3, a top plate 2, which is formed from a synthetic resin, is attached in a removable manner to the frame 1 to cover the upper side of the frame 1.

As shown in FIGS. 1, 2, and 3, a drawer 3, which is formed from a synthetic resin, includes a bottom plate 3*a*, a front plate 3*b*, left and right side plates 3*c*, and a rear plate 3*d*. In this case, the left and right side plates 3*c* are formed integrally with the left and right sides of the bottom plate 3*a*, and the rear plate 3*d* is formed integrally with the rear side of the bottom plate 3*a*. The front plate 3*b* is attached in a removable manner to the front portions of the bottom plate 3*a* and the left and right side plates 3*c*. The drawer 3 is container-like and has an open upper side. The frame 1 and the top plate 2 form a main body D. The drawer 3 can be freely pulled out of and pushed into the main body D through the open front side of the main body D. The frame 1, the top plate 2, and the drawer 3 form a storage case K.

Figure 4:
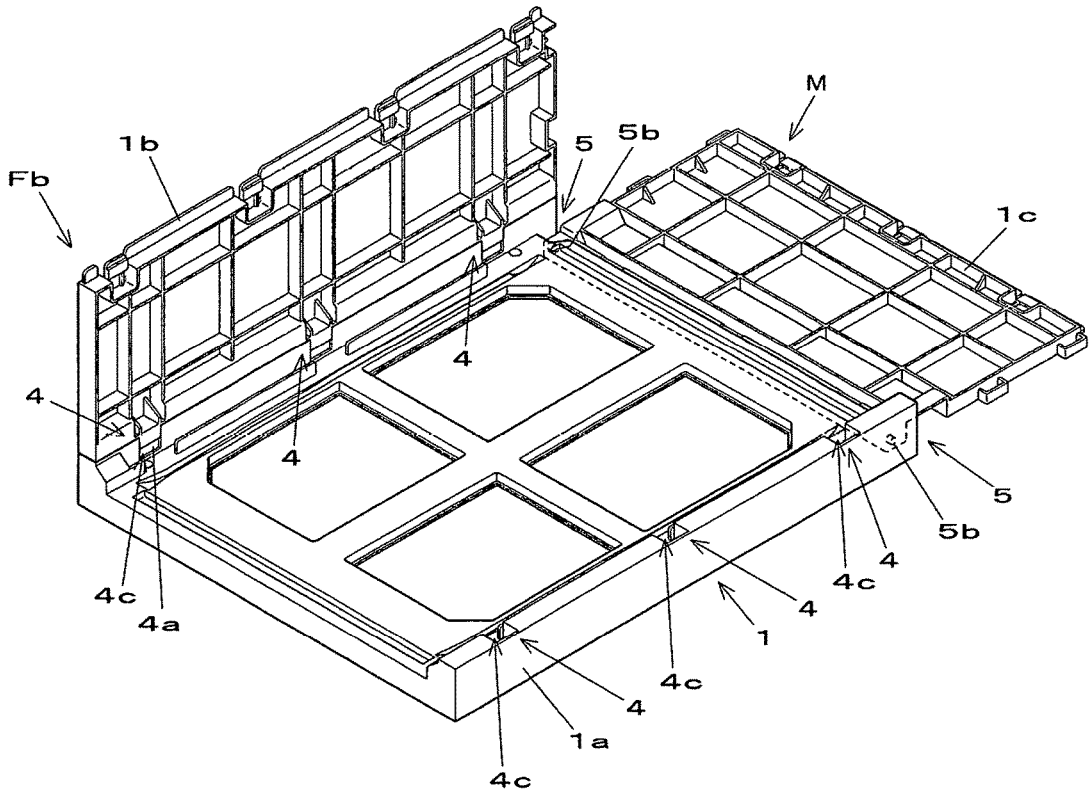
FIG. 4 is a perspective view showing part of the first embodiment according to the present invention.
Figure 5:
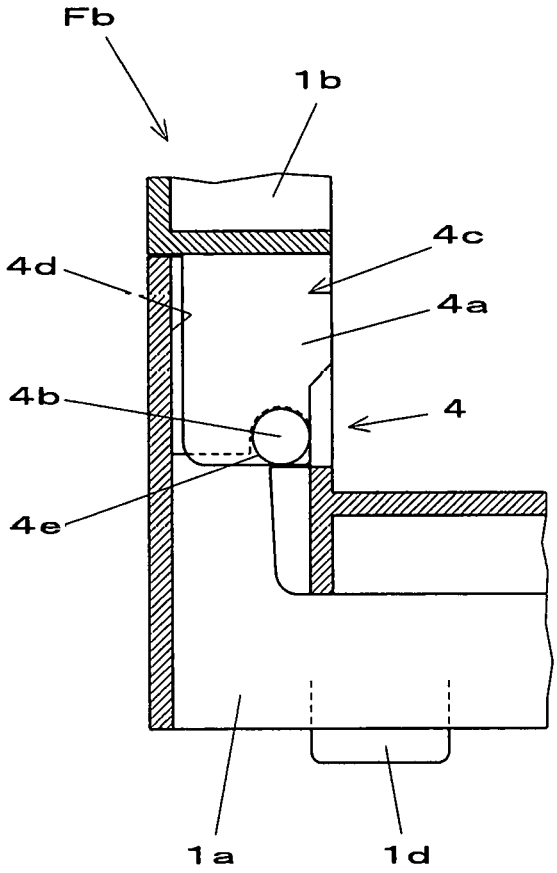
FIG. 5 is a cross-sectional view showing part of the first embodiment according to the present invention.
Figure 6:
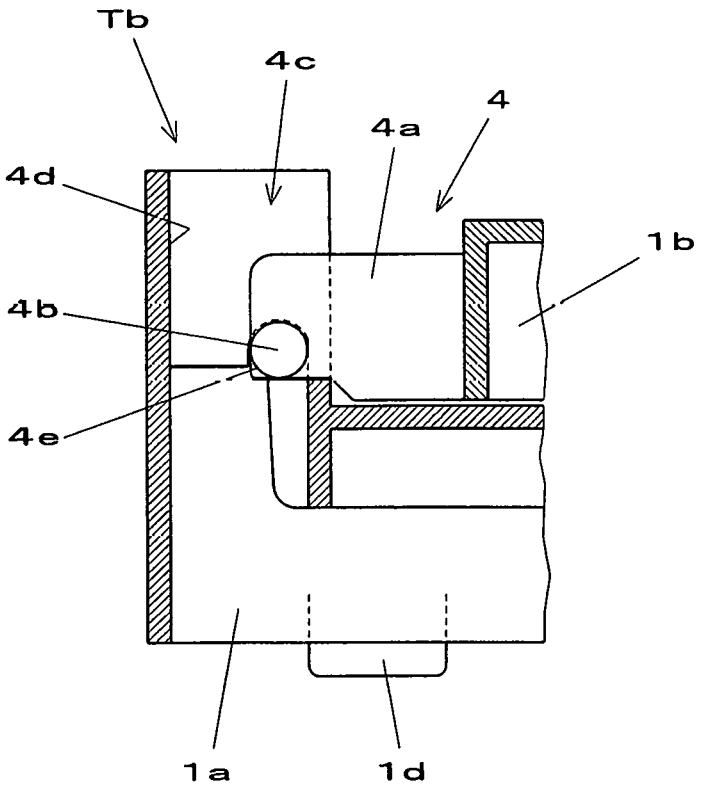
FIG. 6 is a cross-sectional view showing part of the first embodiment according to the present invention.
Figure 7:
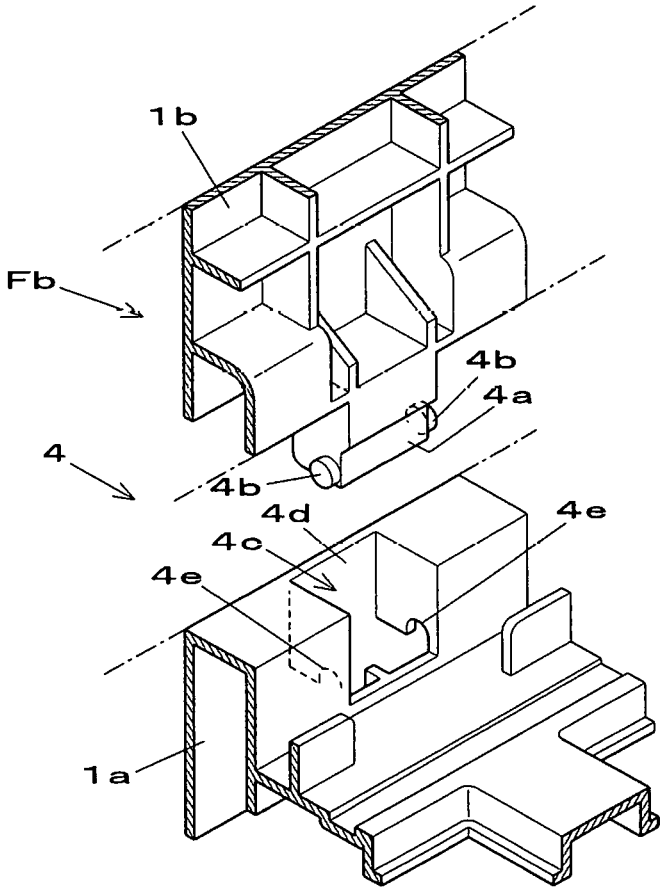
FIG. 7 is an exploded perspective view showing part of the first embodiment according to the present invention.
Figure 8:
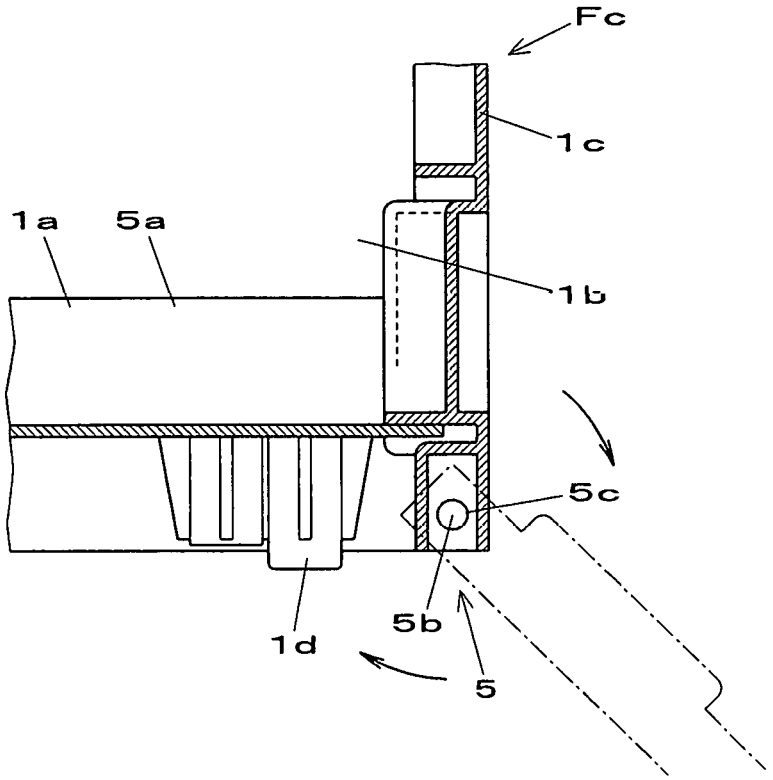
FIG. 8 is a cross-sectional view showing part of the first embodiment according to the present invention.
Figure 9:
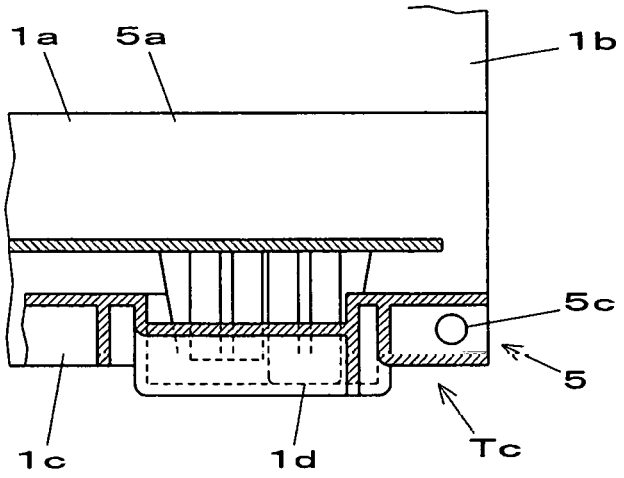
FIG. 9 is a cross-sectional view showing part of the first embodiment according to the present invention.
Figure 10:
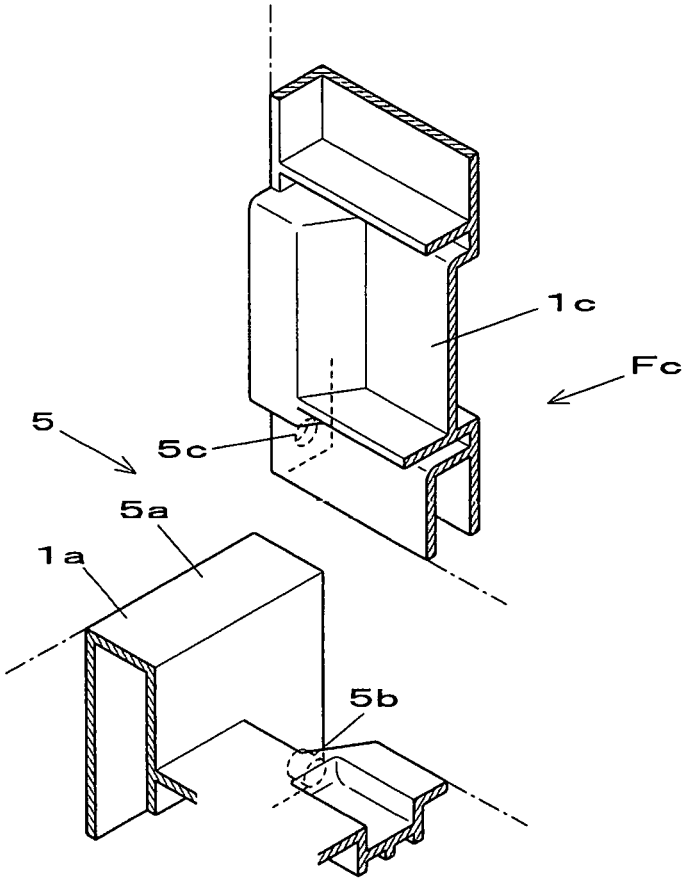
FIG. 10 is a perspective view showing part of the first embodiment according to the present invention.
Figure 11:
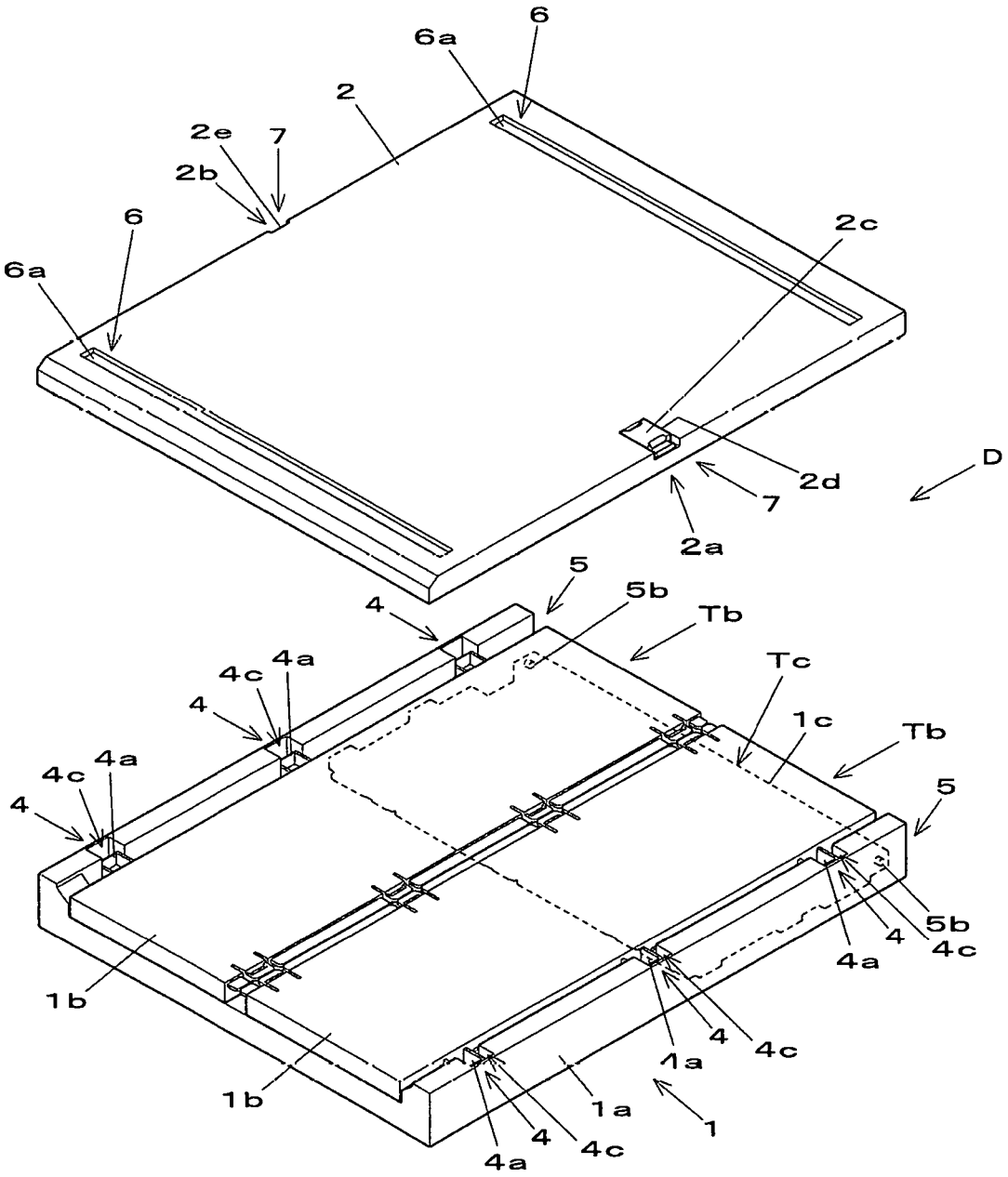
FIG. 11 is a perspective view showing a folded state of the first embodiment according to the present invention

As shown in FIGS. 4 and 11, a side plate folding mechanism 4 allows the left and right side plates 1*b* to be foldable between an upright position Fb shown in FIGS. 3 and 5 and a folded position Tb shown in FIGS. 6 and 11. The left and right side plates 1*b* extend upright from the left and right sides of the bottom plate 1*a* of the frame 1 at the upright position Fb. Further, the left and right side plates 1*b* extend along the upper surface of the bottom plate 1*a* at the folded position Tb. A rear plate folding mechanism 5 allows the rear plate 1*c* to be folded between an upright position Fc shown in FIGS. 3 and 8 and a folded position Tc shown in FIGS. 9 and 11 via an intermediate position M shown in FIG. 4. The rear plate 1*c* extends upright from the rear side of the bottom plate 1*a* of the frame 1. Further, the rear plate 1*c* extends along the lower surface of the bottom plate 1*a* at the folded position Tc.

As shown in FIGS. 4, 5, 6, and 7, each side plate folding mechanism 4 includes three fitting projections 4*a* on the lower side of the corresponding side plate 1*b*, pins 4*b* extending from opposite sides of each fitting projection 4*a*, three fitting recesses 4*c* formed in the corresponding side of the bottom plate 1*a* and fitted with the fitting projections 4*a*, a restriction surface 4*d* formed in each fitting recess 4*c* to restrict further movement of the corresponding fitting projection 4*a* from the upright position Fb, and bearing holes 4*e* that receive the pins 4*b*. The side plate folding mechanisms 4 allows the corresponding side plate 1*b* to be folded between the upright position Fb and the folded position Tb. This structure allows the side plate folding mechanisms 4 to fold the corresponding side plate 1*b* between the upright position Fb and the folded position Tb at which the corresponding side plate 1*b* extends along the upper surface of the bottom plate 1*a*.

As shown in FIGS. 4, 8, 9, and 10, the rear plate folding mechanism 5 includes pins 5*b*, which are formed on the inner surfaces of left and right elevations 5*a* of the bottom plate 1*a*, and bearing holes 5*c*, which are located in the left and right sides of the rear plate 1*c* to receive the pins 5*b*. This structure allows the rear plate folding mechanism 5 to fold the rear plate 1*c* between the upright position Fc and the folded position Tc at which the rear plate 1*c* extends along the lower surface of the bottom plate 1*a*.

Referring to FIGS. 1, 2, and 3, a stable stacking mechanism 6 includes grooves 6*a*, which are formed in the upper surface of the top plate 2 and extend in a direction orthogonal to the moving direction of the drawer 3, and four fitting portions 1*d*, two in the front and two in the rear of the lower surface of the bottom plate 1*a* of the frame 1. The fitting portions 1*d* are movable in the grooves 6*a* of a top plate 2 of another main body D.

The left and right sides of the main body D include two coupling mechanisms 7 capable of coupling the frame 1 and the top plate 2. As shown in FIG. 1, the left and right sides of the top plate 2 include top plate attachment portions 2*a* and 2*b*. When two main bodies D are arranged adjacent to each other in the sideward direction, a coupling member 2*c* is extended across the top plate attachment portions 2*a* and 2*b* of the adjacent main bodies D. The top plate attachment portion 2*a* functions as a projection-retraction attachment portion 2*d* that allows the coupling member 2*c* to move in the sideward direction. The other top plate attachment portion 2*b* functions as a fitting hole portion 2*e* that receives the coupling member 2*c* in an attachable and detachable manner.

Figure 12A:
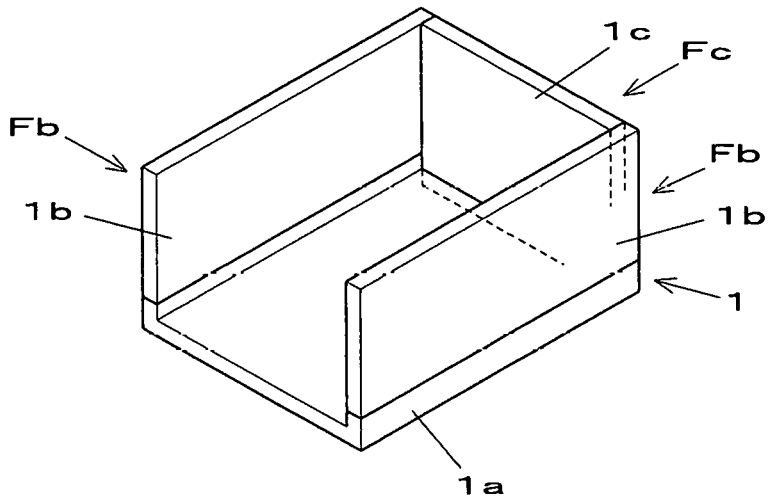
FIGS. 12A to 12D are perspective views showing the folding procedures of the first embodiment according to the present invention
Figure 12B:
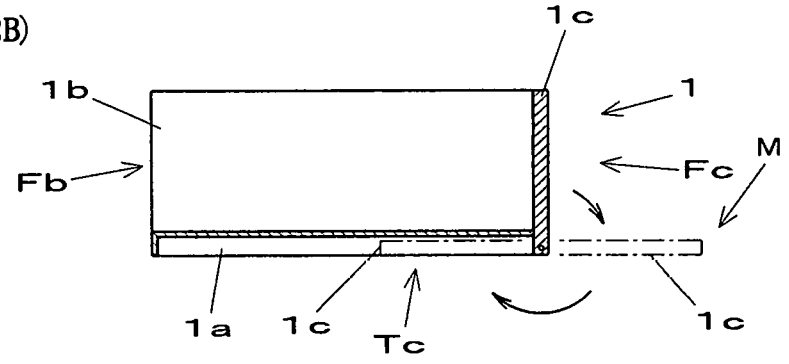
Figure 12C:
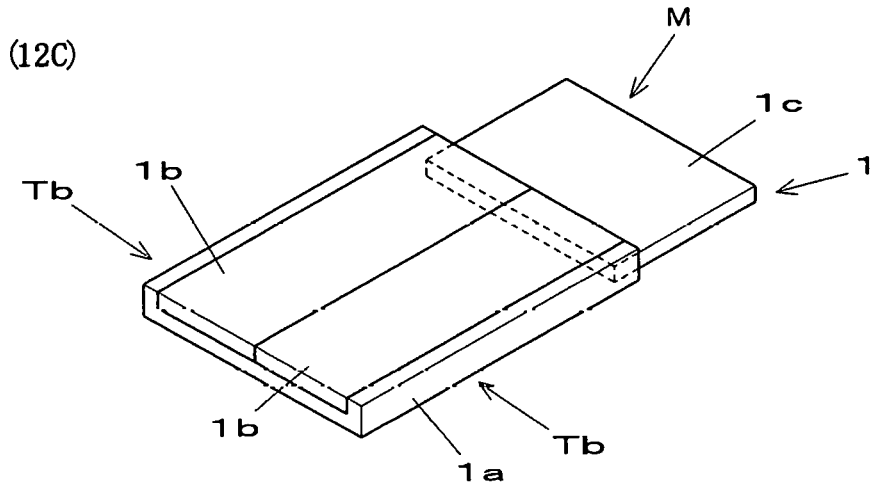
Figure 12D:
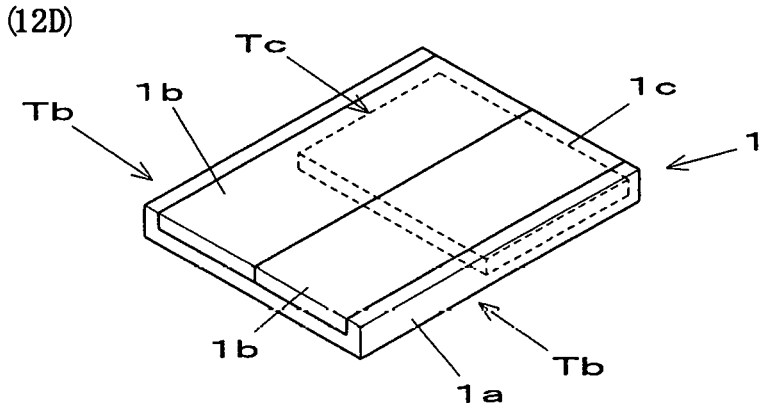
Figure 13:
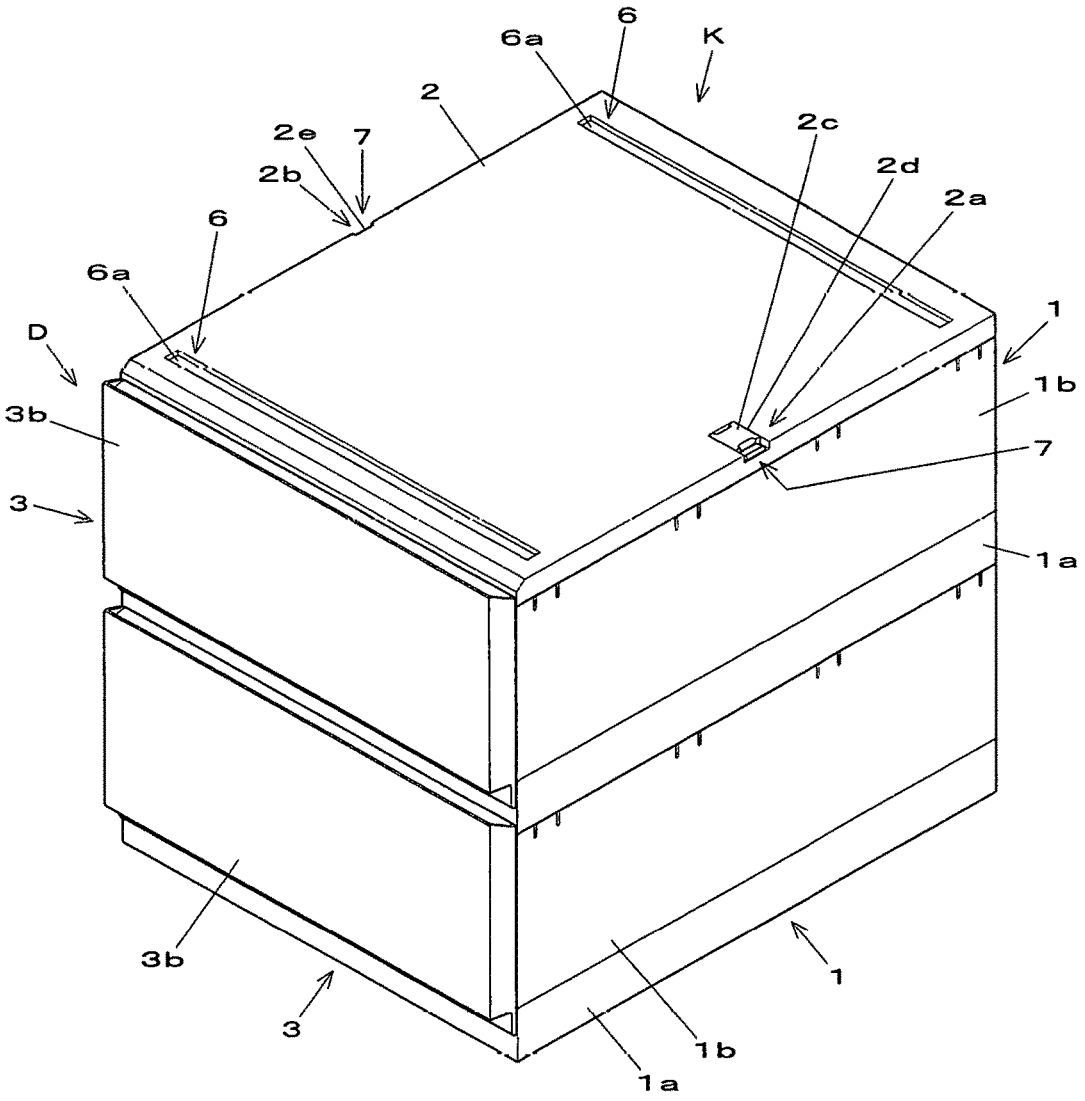
FIG. 13 is a perspective view of a second embodiment according to the present invention.
Figure 14:
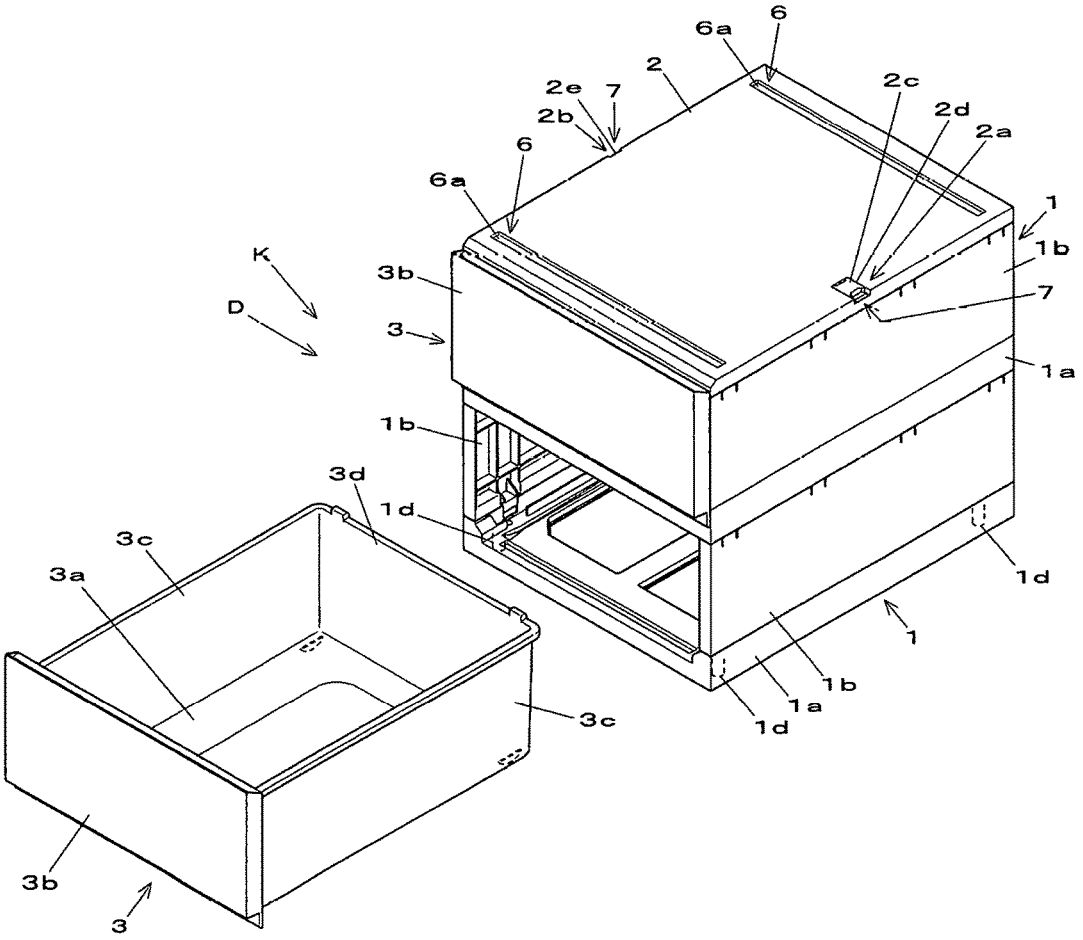
FIG. 14 is a perspective view of the second embodiment according to the present invention.
Figure 15:
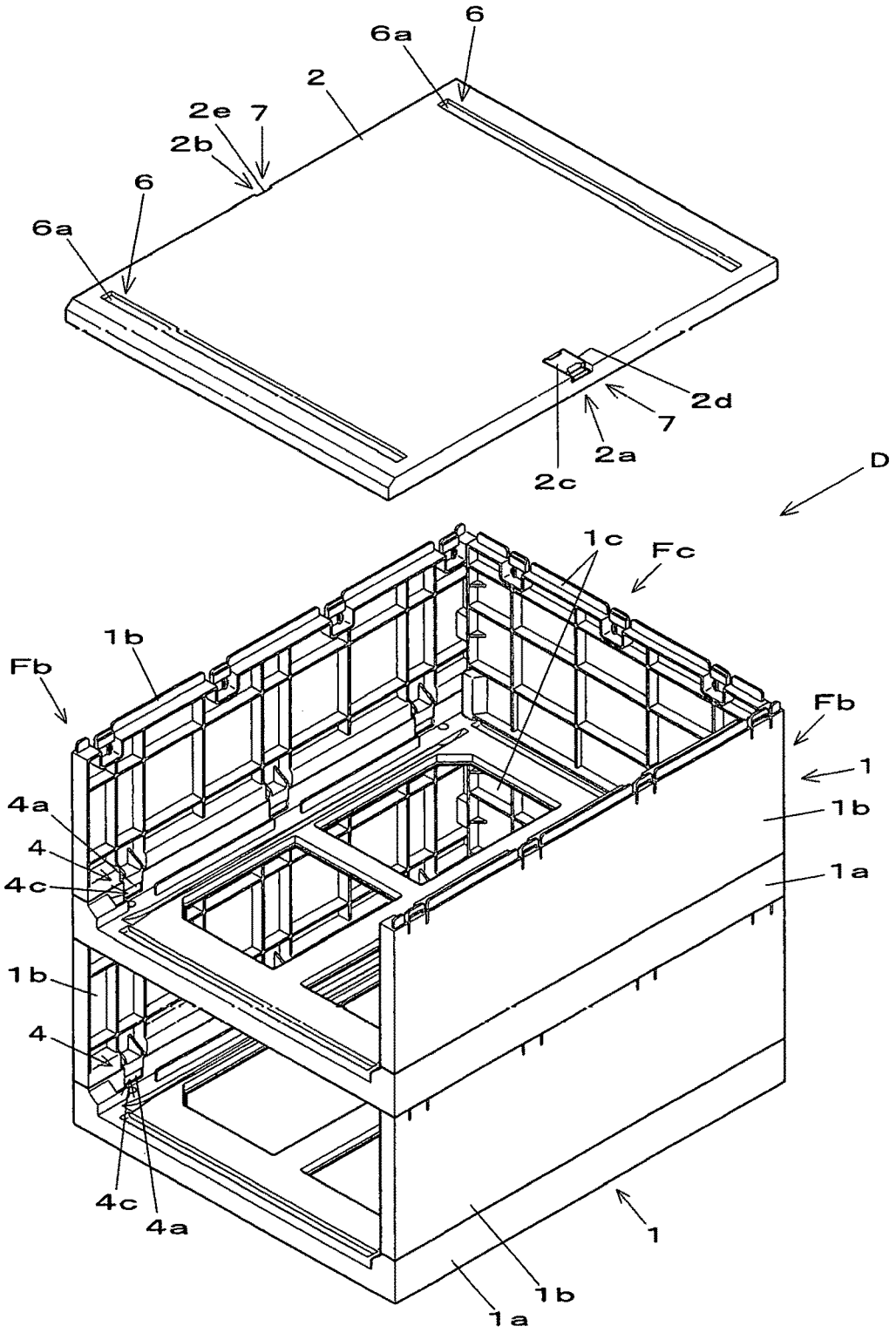
FIG. 15 is an exploded perspective view showing part of the second embodiment according to the present invention.

Referring to FIGS. 4 and 11, when the storage case K is not in use, the side plate folding mechanism 4 allows the left and right side plates 1*b* to be folded from the upright position Fb of FIGS. 3 and 5 to the folded position of FIGS. 6 and 11 in which the side plate 1*b* extend along the upper surface of the bottom plate 1*a*. Further, the rear plate folding mechanism 5 allows the rear plate 1*c* to be folded from the upright position Fc of FIGS. 3 and 8 via the intermediate position M of FIG. 4 to the folded position Tc of FIGS. 9 and 11 in which the rear plate 1*c* extends along the lower surface of the bottom plate 1*a*. FIGS. 12A to 12D illustrate how the frame 1 is folded and unfolded. FIG. 12A shows the frame 1 in a deployed state when in use. From this state, the frame 1 can be folded to the state shown in FIG. 12D when not in use. FIG. 12D shows the frame 1 in a folded state when not in use. From this state, the frame 1 can be deployed to the state shown in FIG. 12A when used. Accordingly, when not in use such as during transportation or storage, the left and right side plates 1*b* can be folded along the upper surface of the bottom plate 1*a*, and the rear plate 1*c* can be folded along the lower surface of the bottom plate 1*a*. When the left and right side plates 1*b* and the rear plate 1*c* are folded, four members, namely, the bottom plate 1*a*, the side plates 1*b*, and the rear plate 1*c* can be folded into a generally planar form. This reduces the size of the frame 1 and the space required to store the frame 1. Thus, the frame 1 can be stored in a small space. This facilitates storage of the frame 1 when not in use. Further, the bottom plate 1*a*, the left and right side plates 1*b*, and the rear plate 1*c* are coupled to one another and do not have to be stored separately. Thus, the bottom plate 1*a*, the left and right side plates 1*b*, and the rear plate 1*c* do not become lost and do not have to be coupled to each other. Further, the storage case K can easily be assembled after purchase. Even an old person or a person in need of care can assemble the storage case K. This improves convenience when using the storage case K.

In a state in which, for example, a plurality storage cases K are stacked, the stable stacking mechanism 6 prevents an upper storage case K from falling off from the front side of the lower storage case K by fitting the fitting portions 1*d* of the upper storage case K into the grooves 6*a* of the lower storage case K. Thus, the stable stacking mechanism 6 increases the stacking stability of the storage cases K. Further, while keeping the storages cases K stably stacked, the layout of the storage cases K can easily be changed in the widthwise direction of the storage cases K, that is, in the direction orthogonal to the moving direction of the drawer 3. This increases the freedom of layout of the storage cases K and allows the layout of the storage cases K, which can be stacked, to be changed in accordance with how the storage cases K are used, where the storage cases K are used, and the items stored in the storage cases K. Thus, the storage cases K can be used in a variety of forms and is convenient.

Further, the coupling mechanisms 7 couple, for example, two storage cases K that are arranged next to each other in the sideward direction. Thus, the storage cases K can be used in a variety of forms and is convenient.

FIGS. 13 to 16 show a second embodiment. As shown in FIGS. 13, 14, 15, and 16, the main body D includes two frames 1, which are stacked one upon the other, and a top plate 2. In the same manner as the first embodiment, each frame 1 is formed from a synthetic resin and includes the bottom plate 1*a*, the left and right side plates 1*b*, the rear plate 1*c*, an open front side, and an upper open side. The top plate 2 covers the upper side of the uppermost one of the stacked frames 1. Two drawers 3, which are formed from a synthetic resin and are open at the upper side, are respectively arranged in the main body D through the open front sides of the frames 1 and can be freely pulled out of and pushed into the main body D. The left and right side plates 1*b* are foldable between the upright position Fb, at which the left and right side plates 1*b* extend upright from the left and right sides of the bottom plate 1*a* of each frame 1, and the folded position Tb, at which the side plates 1*b* extend along the upper surface of the bottom plate 1*a*. Further, the rear plate 1*c* is foldable between the upright position Fc, at which the rear plate 1*c* extends upright from the rear side of the bottom plate 1*a* of the frame 1, and the folded position Tc, at which the rear plate 1*c* extends along the lower surface of the bottom plate 1*a*. In this manner, the storage case K has two levels.

The second embodiment also includes the side plate folding mechanism 4, the rear plate folding mechanism 5, the stable stacking mechanism 6, and the coupling mechanism 7.

Figure 16:
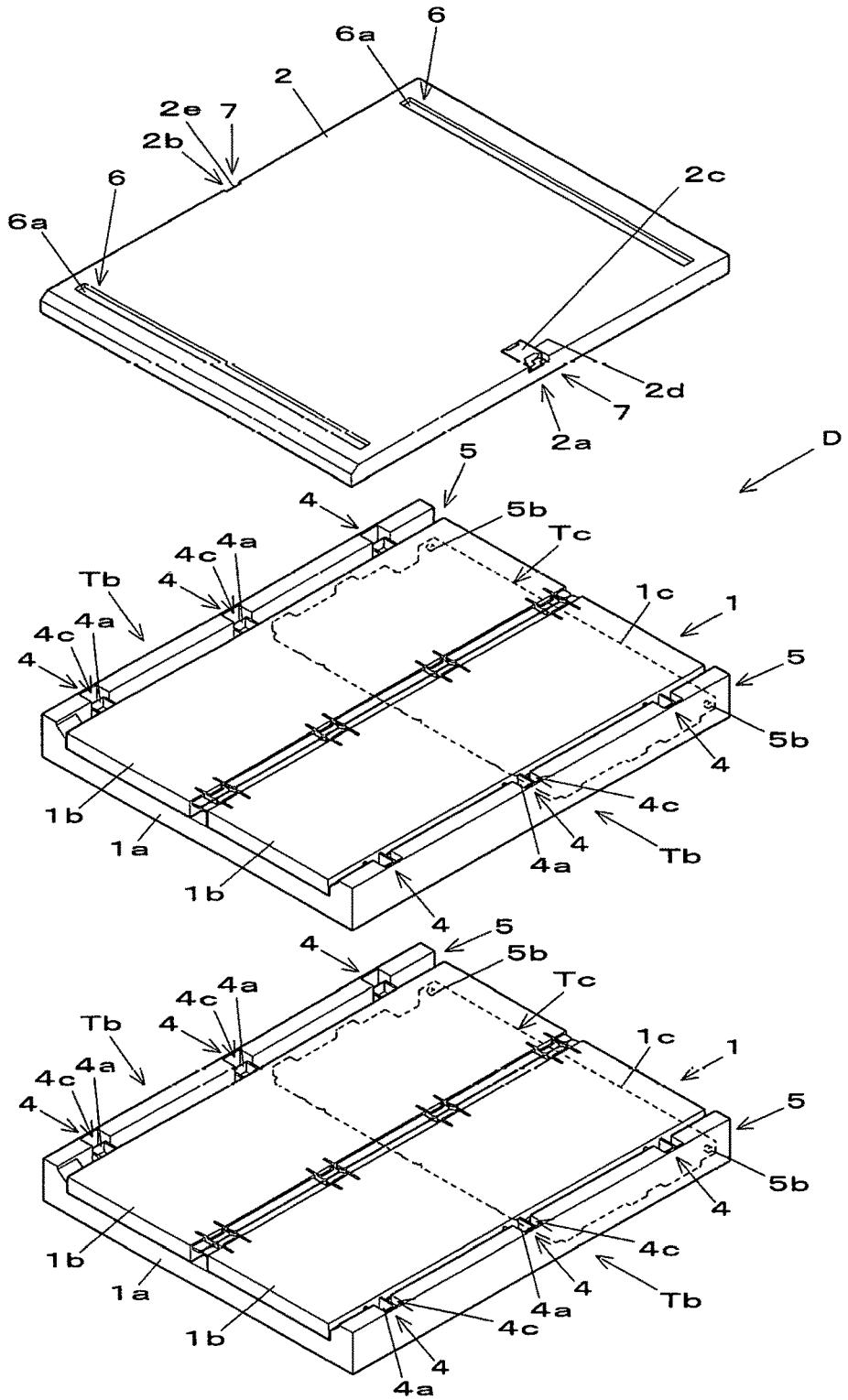
FIG. 16 is a perspective view showing a folded state of the second embodiment according to the present invention.

In the same manner as the first embodiment, as shown in FIG. 16, in the second embodiment, when not in use such as during transportation or storage, the left and right side plates 1*b* of each frame 1 can be folded along the upper surface of the corresponding bottom plate 1*a*, and the rear plate 1*c* of each frame 1 can be folded along the lower surface of the bottom plate 1*a*. When the left and right side plates 1*b* and the rear plate 1*c* are folded, four members, namely, the bottom plate 1*a*, the side plates 1*b*, and the rear plate 1*c* can be folded into a generally planar form. This reduces the size of the frame 1 and the space required to store the frame 1. Thus, the frame 1 can be stored in a small space. This facilitates storage of the frames 1 when not in use. Further, the bottom plate 1*a*, the left and right side plates 1*b*, and the rear plate 1*c* of each frame 1 are coupled to one another and do not have to be stored separately. Thus, the bottom plate 1*a*, the left and right side plates 1*b*, and the rear plate 1*c* do not become lost and do not have to be coupled to each other. Further, the storage case K can easily be assembled after purchase. Even an old person or a person in need of care can assemble the storage case K. This improves convenience when using the storage case K.

The present invention is not limited to the upper embodiment. For example, the number of the frames 1, the stacked number of the frames 1, the size of the frames 1, the shape of the top plate 2, the number of the drawers 3, and the structure may be changed in accordance with the application.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A storage case comprising:

a frame including a bottom plate, left and right side plates, a rear plate, an open front side, and an open upper side, wherein the frame is formed from a synthetic resin;

a top plate that covers the upper side of the frame body, wherein the top plate is formed from a synthetic resin;

a main body including the frame and the top plate; and a drawer that is freely pulled out of and pushed into the main body through the open front side of the frame in the main body, wherein the drawer is formed from a synthetic resin and includes an open upper side, wherein grooves are formed in an upper surface of the top plate and extend in a direction orthogonal to a moving direction of the drawer; left and right sides of the top plate each comprises a top plate attachment portion; the top plate attachment portion on one side is a projection-retraction attachment portion that allows a coupling member to move in a sideward direction; the top plate attachment portion on another side is a fitting hole portion that detachably receives another coupling member of another adjacently disposed storage case;

the left and right side plates are foldable between an upright position, at which the left and right side plates extend upright from left and right sides of the bottom plate of the frame, and a folded position, at which the left and right side plates extend along an upper surface of the bottom plate, via a side plate folding mechanism on each side; wherein the side plate folding mechanism on each side comprises three fitting projections on a lower side of a corresponding side plate, pins extending from opposite sides of each fitting projection, three fitting recesses formed in a corresponding side of the bottom plate and fitted with the fitting projections, a restriction surface formed in each fitting recess to restrict further movement of the corresponding fitting projection from the upright position, and bearing holes that receive the pins; and the rear plate is foldable between an upright position, at which the rear plate extends upright from a rear side of the bottom plate of the frame, and a folded position, at which the rear plate extends along a lower surface of the bottom plate.

2. A storage case comprising:

a plurality of frames that can be stacked one upon the other, each frame including a bottom plate, left and right side plates, a rear plate, an open front side, and an open upper side, wherein the frames are formed from a synthetic resin;

a top plate that covers the upper side of an uppermost one of the stacked frames, wherein the top plate is formed from a synthetic resin;

a main body including the frames and the top plate; and a plurality of drawers that are freely pulled out of and pushed into the main body through the open front sides of the frames in the main body, wherein the drawers are formed from a synthetic resin and each of the drawers includes an open upper side, wherein grooves are formed in an upper surface of the top plate and extend in a direction orthogonal to a moving direction of the drawers; left and right sides of the top plate each comprises a top plate attachment portion; the top plate attachment portion on one side is a projection-retraction attachment portion that allows a coupling member to move in a sideward direction; the top plate attachment portion on another side is a fitting hole portion that detachably receives another coupling member of another adjacently disposed storage case;

the left and right side plates of each frame are foldable between an upright position, at which the left and right side plates extend upright from left and right sides of the corresponding bottom plate, and a folded position, at which the left and right side plates extend along an upper surface of the corresponding bottom plate, via a side plate folding mechanism on each side; wherein the side plate folding mechanism on each side comprises three fitting projections on a lower side of a corresponding side plate, pins extending from opposite sides of each fitting projection, three fitting recesses formed in a corresponding side of the bottom plate and fitted with the fitting projections, a restriction surface formed in each fitting recess to restrict further movement of the corresponding fitting projection from the upright position, and bearing holes that receive the pins; and the rear plate of each frame is foldable between an upright position, at which the rear plate extends upright from a rear side of the corresponding bottom plate, and a folded position, at which the rear plate extends along a lower surface of the corresponding bottom plate.

* * * * *